US010105022B2

(12) United States Patent
Lim et al.

(10) Patent No.: US 10,105,022 B2
(45) Date of Patent: Oct. 23, 2018

(54) VACUUM CLEANER

(71) Applicant: SAMSUNG ELECTRONICS CO., LTD., Suwon-si, Gyeonggi-do (KR)

(72) Inventors: Tae Woon Lim, Suwon-si (KR); Tae Gwang Kim, Gwangju (KR); Jeong Hee Cho, Gwangju (KR); Tak Soo Kim, Gwangju (KR); Dong Hun Yoo, Gwangju (KR); Byung Jo Lee, Gwangju (KR); Yun Won Jung, Gwangju (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 649 days.

(21) Appl. No.: 14/476,065

(22) Filed: Sep. 3, 2014

(65) Prior Publication Data

US 2015/0059118 A1 Mar. 5, 2015

(30) Foreign Application Priority Data

Sep. 5, 2013 (KR) ..... 10-2013-0106743
May 2, 2014 (KR) ..... 10-2014-0053519
May 12, 2014 (KR) ..... 10-2014-0056771

(51) Int. Cl.
*A47L 5/22* (2006.01)

(52) U.S. Cl.
CPC ..... *A47L 5/225* (2013.01)

(58) Field of Classification Search
CPC ... A47L 5/225; A47L 5/24; A47L 9/02; A47L 9/1691; A47L 9/22; A47L 9/242
See application file for complete search history.

(56) References Cited

U.S. PATENT DOCUMENTS 4,644,605 A * 2/1987 Joss ..... A47L 5/225 15/329
5,031,266 A * 7/1991 Tillman ..... A47L 9/242 15/327.2
6,122,796 A * 9/2000 Downham ..... A47L 5/00 15/328

(Continued)

FOREIGN PATENT DOCUMENTS

CN 1145770 3/1997
CN 201790739 4/2011

(Continued)

OTHER PUBLICATIONS

European Search Report dated Feb. 16, 2015 in corresponding European Patent Application No. 14183843.3.

(Continued)

*Primary Examiner* — Robert Scruggs
(74) *Attorney, Agent, or Firm* — Staas & Halsey LLP

(57) ABSTRACT

A vacuum cleaner that includes a first cleaner module and a second cleaner module that is removably coupled to the first cleaner module. The first cleaner module includes a first body and a first dust collection unit, and the second cleaner module includes a second body and a second dust collection unit. Thus, when done in an upright mode, cleaning can be done with a sufficiently great suction force. When done in a handy mode after the second cleaner module is separated, cleaning can be easily done using the second cleaner module.

17 Claims, 20 Drawing Sheets

(56) References Cited

U.S. PATENT DOCUMENTS

| | | | | |
|---|---|---|---|---|
| 7,676,883 | B2 * | 3/2010 | MacLeod | A47L 5/32 15/334 |
| 8,225,457 | B2 * | 7/2012 | Sanderson | A47L 5/32 15/334 |
| 8,677,554 | B2 * | 3/2014 | Conrad | A47L 5/225 15/331 |
| 2007/0136984 | A1 | 6/2007 | Hsu | |
| 2008/0040883 | A1 * | 2/2008 | Beskow | A47L 5/225 15/329 |
| 2012/0030896 | A1 * | 2/2012 | Crouch | A47L 5/225 15/339 |

FOREIGN PATENT DOCUMENTS

| | | |
|---|---|---|
| CN | 102440717 | 5/2012 |
| EP | 1 815 777 | 8/2007 |
| WO | 97/20492 | 6/1997 |
| WO | WO 97/20491 | 6/1997 |

OTHER PUBLICATIONS

Chinese Office Action dated Nov. 24, 2017 in Chinese Patent Application No. 201410453424.3.
Chinese Office Action dated Jun. 14, 2018 in Chinese Patent Application No. 201410453424.3.

* cited by examiner

VACUUM CLEANER

CROSS-REFERENCE TO RELATED APPLICATIONS

This application claims the benefit of Korean Patent Application Nos. 10-2013-0106743, filed on Sep. 5, 2013, 10-2014-0053519, filed on May 2, 2014, and 10-2014-0056771, filed on May 12, 2014, in the Korean Intellectual Property Office, the disclosures of which are incorporated herein by reference.

BACKGROUND

1. Field

Embodiments of the present disclosure relate to a vacuum cleaner capable of being used in an upright mode and a handy mode.

2. Description of the Related Art

In general, vacuum cleaners are appliances designed to do cleaning by suctioning dust along with air using a suction force generated from a fan rotated by a motor, separating the dust included in the suctioned air from the air, and collecting the separated dust.

Such vacuum cleaners include a main body with a fan motor generating a suction force, a head unit that is disposed in the front of the main body and suctions dust from a floor along with air, a handle grasped by a user so as to allow movement of the vacuum cleaner, and an extension frame that connects the handle and the main body and enables the user to move the main body in a standing posture.

Some of the vacuum cleaners have recently been designed to include a first cleaner module that cleans a floor in an upright mode and a second cleaner module that is removably installed on the first cleaner module and is used in a handy mode, thereby making it possible to be used in the upright mode and the handy mode.

SUMMARY

Therefore, it is an aspect of the present disclosure to provide a vacuum cleaner capable of efficiently doing cleaning according to a cleaning mode.

Additional aspects of the disclosure will be set forth in part in the description which follows and, in part, will be apparent from the description, or may be learned by practice of the disclosure.

In accordance with one aspect of the present disclosure, a vacuum cleaner includes a first cleaner module cleaning a floor in an upright mode, and a second cleaner module that is removably coupled to the first cleaner module and is separated from the first cleaner module so as to do cleaning in a handy mode. The first cleaner module includes a first fan motor generating a suction force, and a first dust collection unit filtering foreign materials from air suctioned by the first fan motor, and the second cleaner module includes a second fan motor generating a suction force when used in the handy mode, and a second dust collection unit filtering foreign materials from air suctioned by the second fan motor.

Here, the first fan motor may generate the suction force greater than that of the second fan motor.

Further, the second cleaner module may include a handle used for both cleaning in the upright mode and cleaning in the handy mode.

Also, the first cleaner module may include a first body housing the first fan motor, a head unit that is disposed at a front side of the first body and suctions the air from the floor, and an extension frame connected to the first body, and the second cleaner module may be removably coupled to the extension frame.

Further, one of the first cleaner module and the extension frame may include a protruding male coupler, and the other may include a female coupler to which the male coupler is coupled.

Further, one of the first and second cleaner modules may include a plug module, and the other may include a socket module to which the plug module is connected.

In addition, the first cleaner module may include an upright connector formed by the plug module, and the second cleaner module may include a handy connector that is formed by the socket module and is connected to the upright connector.

Further, the second cleaner module may further include a switch that causes power to be selectively applied to the socket module when the male coupler is coupled to the female coupler.

Further, the first cleaner module may include the male coupler for the extension frame, and the second cleaner module may include the female coupler.

Further, the extension frame may include a cover that is provided at an upper end thereof and covers a part of a second body adjacent to the female coupler.

Also, the cover may include a guide rail that is formed on an inner surface thereof and guides entry of the second body, and the second body may include a guide groove that is provided at a portion adjacent to the female coupler and guides the guide rail.

Further, the vacuum cleaner may further include a locking device that keeps the second cleaner module coupled to the first cleaner module.

Further, the locking device may include a locking member that is rotatably installed on the extension frame, an elastic member that elastically supports the locking member and causes the locking member to protrude from the extension frame when the locking member is rotated in a first direction, and a lever that is rotatably installed on the extension frame and enables a user to rotate the locking member in a second direction opposite to the first direction.

Further, the lever may include a lever section that receives a force from the user, and a first cam section that interacts with the locking member, and the locking member may include a locking section locked in a locking recess, and a second cam section that interacts with the first cam section by the rotation of the lever.

Further, the second dust collection unit may include a dust collecting case in which dust is collected, and at least one cyclone member that is disposed in the dust collecting case and guides air to flow in a spiral direction.

Further, the dust collecting case may include a partition that partitions an interior thereof into a first dust collecting section that is formed in an annular shape, and a second dust collecting section that is formed inside the first dust collecting section, and the at least one cyclone member may include a first cyclone member that causes the foreign materials to be collected on the first dust collecting section, and a second cyclone member that is disposed inside the first cyclone member and causes the foreign materials to be collected on the second dust collecting section.

Further, the second dust collection unit may include a channel forming member that is installed at one open side of the dust collecting case and guides the air suctioned to the cyclone members and the air discharged from the cyclone members. The channel forming member may include a first cyclone channel that guides the air between the first cyclone member and the dust collecting case so as to be inclined to a circumferential inner side, and a discharge channel that guides discharge of the air passing through the second cyclone member. The first cyclone member may include communicating holes that allow the air to flow into a space between the first and second cyclone members, and the second cyclone member may include at least one second cyclone channel that guides the air inside the second cyclone member so as to be inclined to the circumferential inner side.

In addition, the at least one second cyclone channel may include multiple second cyclone channels disposed in a circumferential direction.

In accordance with another aspect of the present disclosure, a vacuum cleaner includes a first cleaner module for cleaning a floor, and a second cleaner module that is removably coupled to the first cleaner module. The first cleaner module includes a first body, and an extension frame that is connected to the first body and is installed such that the second cleaner module is separable therefrom. The second cleaner module includes a second body, and an extension pipe installed on the second body, and the second body includes a handle which is provided at one side thereof and is grasped by a user, and is available through the handle in an upright mode in a state in which the second cleaner module is installed on the extension frame.

In accordance with still another aspect of the present disclosure, a dust collection unit and a vacuum cleaner includes a dust collecting case in which dust is collected, and a channel forming member that forms a channel guiding air suctioned to the dust collecting case and air discharged from the dust collecting case. The dust collecting case has an interior partitioned into a first dust collecting section in which the dust is primarily collected and a second dust collecting section in which the dust is secondarily collected, and the channel forming member includes a suction port which an outer circumferential surface thereof is partly open to form, and a first suction channel that is provided inside the suction port and guides the air suctioned to the first dust collecting section.

Here, the channel forming member may include multiple second suction channels that are provided at an inner side thereof and guide the air suctioned to the second dust collecting section, and the first suction channel and the second suction channels may be located on the same circumference.

Further, the first dust collecting section may be formed in the dust collecting case in an annular shape, and the second dust collecting section may be formed inside the first dust collecting section.

Further, the first suction channel may extend in a direction tangent to the first dust collecting section, and the second suction channels may extend in a direction tangent to the second dust collecting section.

Further, the channel forming member may include a suction guide that extends inside the suction port in a circumferential direction and forms the first suction channel, and the suction guide may extend to be inclined toward the dust collecting case.

Further, the dust collecting case may be formed in a shape of a hollow cylinder, one side of which is closed, and be provided such that the first dust collecting section and the second dust collecting section are partitioned by an annular partition, and the channel forming member may be installed to cover one side of the dust collecting case, and guide the air suctioned to the first dust collecting section and the air discharged from the second dust collecting section.

Further, the dust collection unit may further include a first cyclone member that causes a cyclonical flow to occur at the first dust collecting section, and a second cyclone member that is disposed inside the first cyclone member and causes the cyclonical flow to occur at the second dust collecting section. The first suction channel may be formed in the channel forming member, and the second suction channels may be formed in the second cyclone member.

Further, the first cyclone member may include a first cyclone flow section that is formed in a hollow truncated cone shape, and multiple communicating holes that are provided for the first cyclone flow section such that the air of the first dust collecting section is introduced into the first cyclone flow section.

Also, the second cyclone member may include a second cyclone flow section that is formed in a hollow truncated cone shape and is disposed inside the first cyclone flow section in a separated state, and the multiple second suction channels may be provided inside the second cyclone flow section.

Further, the channel forming member may include a discharge channel that is formed in the center thereof in order to guide the discharged air.

Further, the channel forming member may include multiple guide ribs that protrude from an inner circumferential surface of the discharge channel and are disposed away from one another in a circumferential direction.

In addition, the dust collection unit may further include a filter that is disposed to cover the discharge channel and filters foreign materials from the air discharged through the discharge channel.

In accordance with yet another aspect of the present disclosure, a vacuum cleaner includes a first cleaner module cleaning a floor, and a second cleaner module that is removably coupled to the first cleaner module and is separated from the first cleaner module so as to do cleaning in a handy mode. The second cleaner module includes a body in which a fan motor generating a suction force is housed, an extension pipe that is provided at one side of the body and enables a user to do cleaning in a state away from a target, and a dust collection unit that separates dust from air suctioned through the extension pipe. The dust collection unit includes a suction port which an outer circumferential surface thereof is partly open to form for the air suction and which is opposite to the extension pipe with the dust collection unit mounted to the body.

As described above, the vacuum cleaner according to the embodiment of the present disclosure includes a first cleaner module having a first dust collection unit and a second cleaner module having a second dust collection unit. According to a cleaning mode, one of the first and second dust collection units is selectively operated, so that cleaning can be efficiently done.

Further, the vacuum cleaner according to the embodiment of the present disclosure can do cleaning in an upright mode by moving the first cleaner module using a handle provided for the second cleaner module in a state in which the second cleaner module is coupled to the first cleaner module.

As described above, in the dust collection unit and the vacuum cleaner according to the embodiment of the present disclosure, an opening is formed in an outer circumferential surface of a channel forming member, and a first suction channel is provided inside the opening. As such, no structure protrudes outside the dust collection unit, so that the dust collection unit can be made more compact.

Further, when the aforementioned dust collection unit is installed on a body of the second cleaner module, an opening of the dust collection unit is opposite to an extension pipe, so that a channel inside the body can be made simpler.

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

Figure 1:
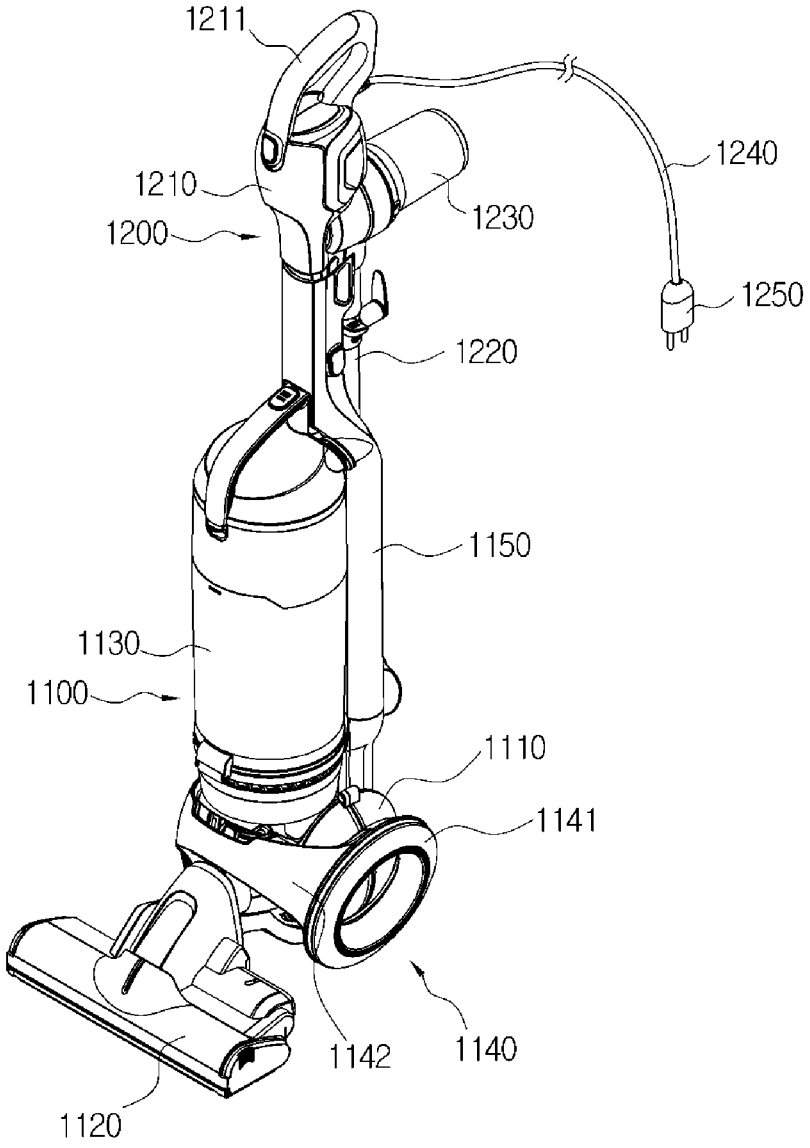
FIG. 1 is a perspective view of a vacuum cleaner according to an embodiment of the present disclosure.
Figure 2:
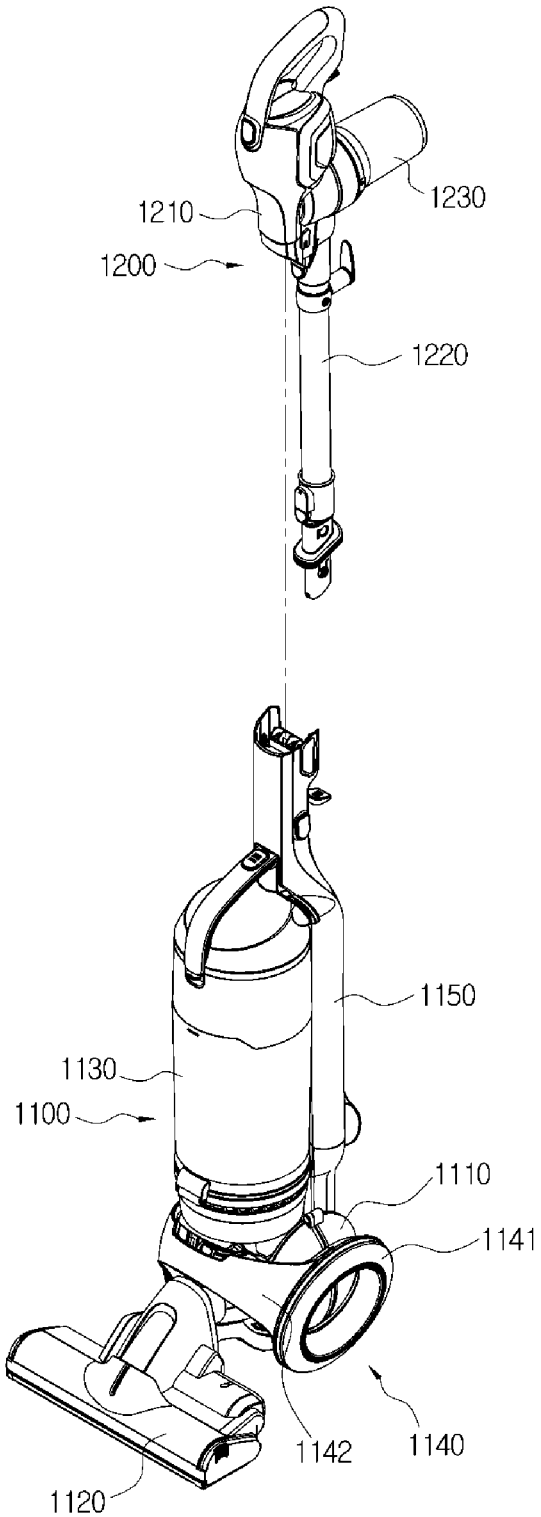
FIG. 2 is a front perspective view illustrating a state in which a first cleaner module and a second cleaner module are separated in the vacuum cleaner according to the embodiment of the present disclosure.
Figure 3:
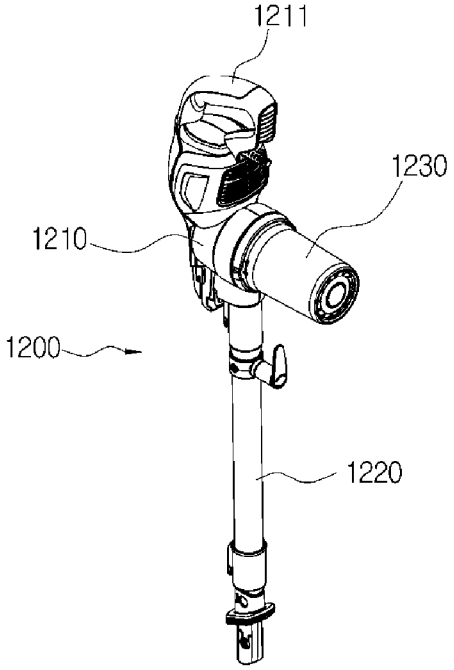
FIG. 3 is a rear perspective view illustrating the state in which the first cleaner module and the second cleaner module are separated in the vacuum cleaner according to the embodiment of the present disclosure.
Figure 3:
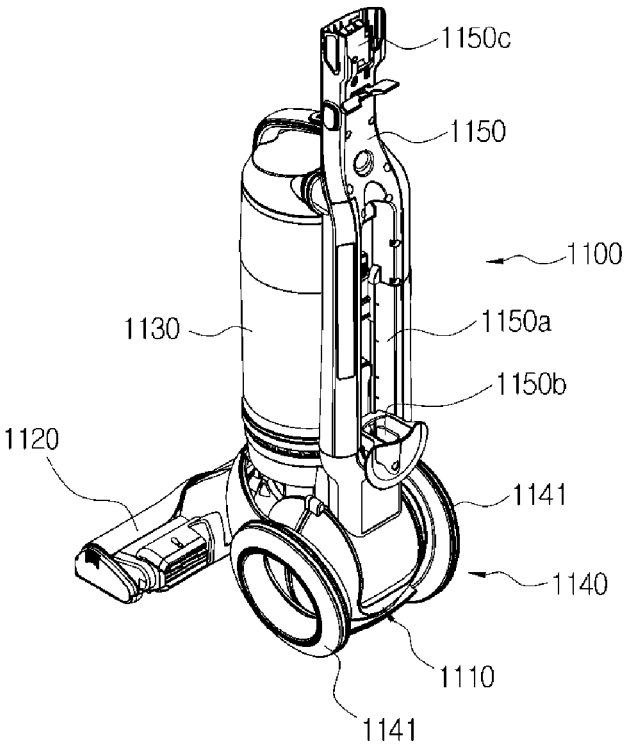
Figure 4:
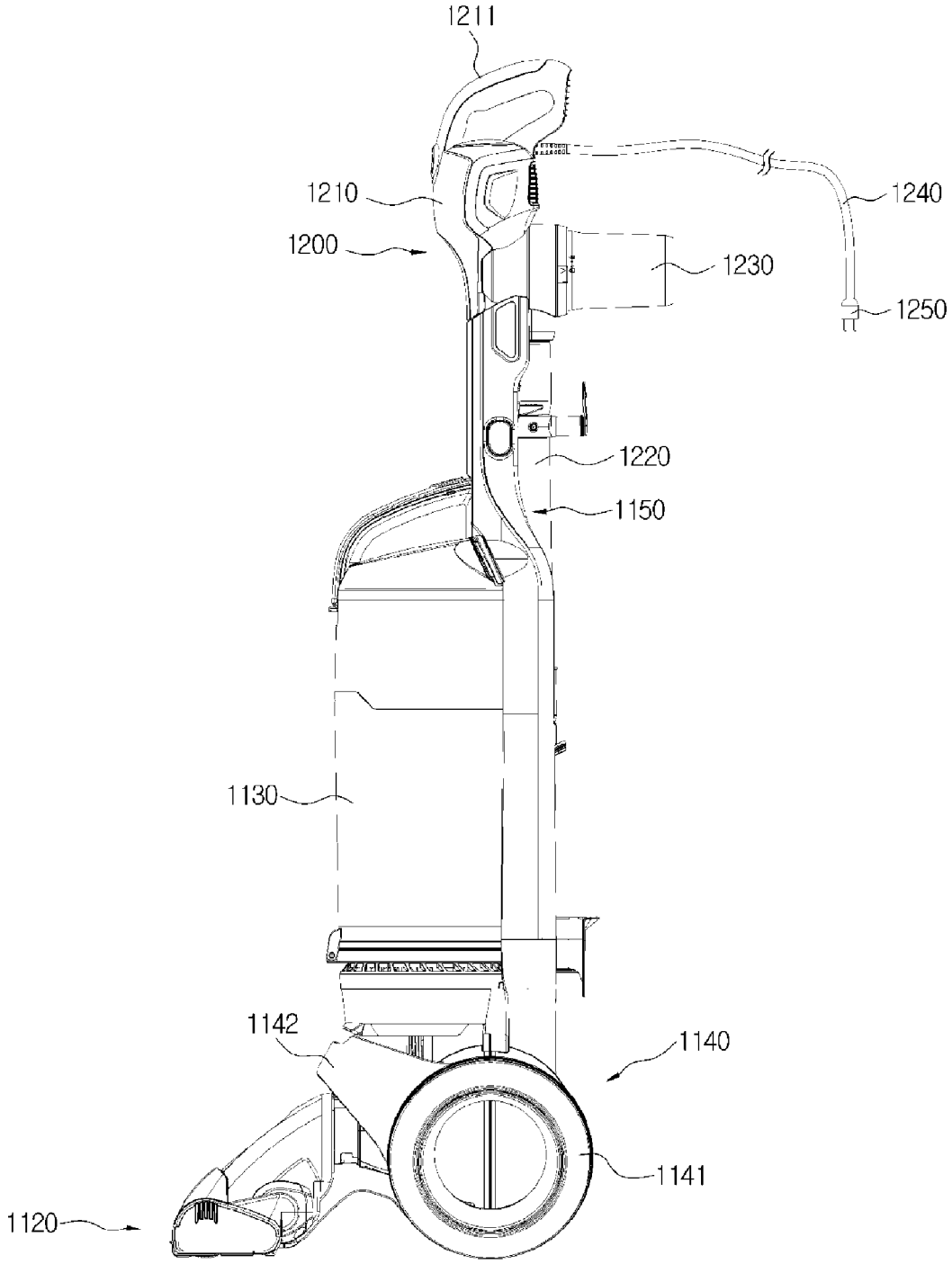
FIG. 4 is a side view of the vacuum cleaner according to the embodiment of the present disclosure.

Reference will now be made in detail to the embodiments of the present disclosure, examples of which are illustrated in the accompanying drawings, wherein like reference numerals refer to like elements throughout.

Hereinafter, a vacuum cleaner according to a first embodiment of the present disclosure will be described in detail with reference to the drawings.

As illustrated in FIGS. 1 to 4, a vacuum cleaner according to a first embodiment of the present disclosure includes a first cleaner module 1100 capable of cleaning a floor in an upright mode, and a second cleaner module 1200 that is removably installed on the first cleaner module 1100 and is capable of doing cleaning in a handy mode after separation from the first cleaner module 1100.

The first cleaner module 1100 includes a first body 1110 in which a first fan motor (not shown) generating a suction force is housed, a head unit 1120 that is connected to a front side of the first body 1110, comes into contact with a floor to be cleaned, and suctions dust on the floor along with air, a first dust collection unit 1130 that separates the dust from the air suctioned through the head unit 1120 by the suction force generated from the first fan motor, a wheel assembly 1140 that is mounted on the first body 1110 and allows the first body 1110 to move along the floor to be cleaned, and an extension frame 1150 that extends upwardly from the first body 1110. The second cleaner module 1200 is removably installed on the extension frame 1150.

The first fan motor generating the suction force is mounted in the first body 1110, and the first body 1110 can move along the floor through the wheel assembly 1140. Further, the first dust collection unit 1130 described above is mounted on an upper portion of the first body 1110.

The head unit 1120 is provided with a suction port (not shown) in a bottom thereof so as to receive the suction force generated from the first fan motor to suction the dust from the floor to be cleaned. The suction port (not shown) that receives the suction force to suction foreign materials along with air, and a brush (not shown) that is rotatably installed in the suction port so as to be able to easily clean, for instance, a carpet are disposed on the bottom of the head unit 1120.

The first dust collection unit 1130 receives the air suctioned by the head unit 1120, separates the dust included in the air, and collects the separated dust. In the present embodiment, the first dust collection unit 1130 separates and collects the dust from the air in a cyclone mode.

The wheel assembly 1140 includes a pair of wheels 1141 disposed on both left and right sides, and a wheel bracket 1142 on which the two wheels 1141 are rotatably installed and which rotatably supports the first body 1110.

The second cleaner module 1200 includes a second body 1210 in which a second fan motor (not shown) generating a suction force is housed, an extension pipe 1220 that is provided at one side of the second body 1210 so as to enable a user to do cleaning in a separated state from a target to be cleaned, a second dust collection unit 1230 that separates the dust from the air suctioned through the extension pipe 1220 and collects the separated dust, and an extension cable 1240 and a plug 1250 which are used for connection to an external power supply (not shown). The second body 1210 includes a handle 1211 at one side thereof such that the user can grasp the handle to use the second cleaner module 1200.

The second fan motor generating the suction force is mounted in the second body 1210. Based on the drawings, the aforementioned handle 1211 is provided at an upper end of the second body 1210, and the aforementioned extension pipe 1220 is connected to a lower end of the second body 1210.

The extension pipe 1220 is removably installed on the second body 1210. The extension pipe 1220 is connected to the second body 1210 such that air can be suctioned through the extension pipe 1220, or the extension pipe 1220 is separated from the second body 1210 such that air can be directly suctioned to the second body 1210.

Figure 5:
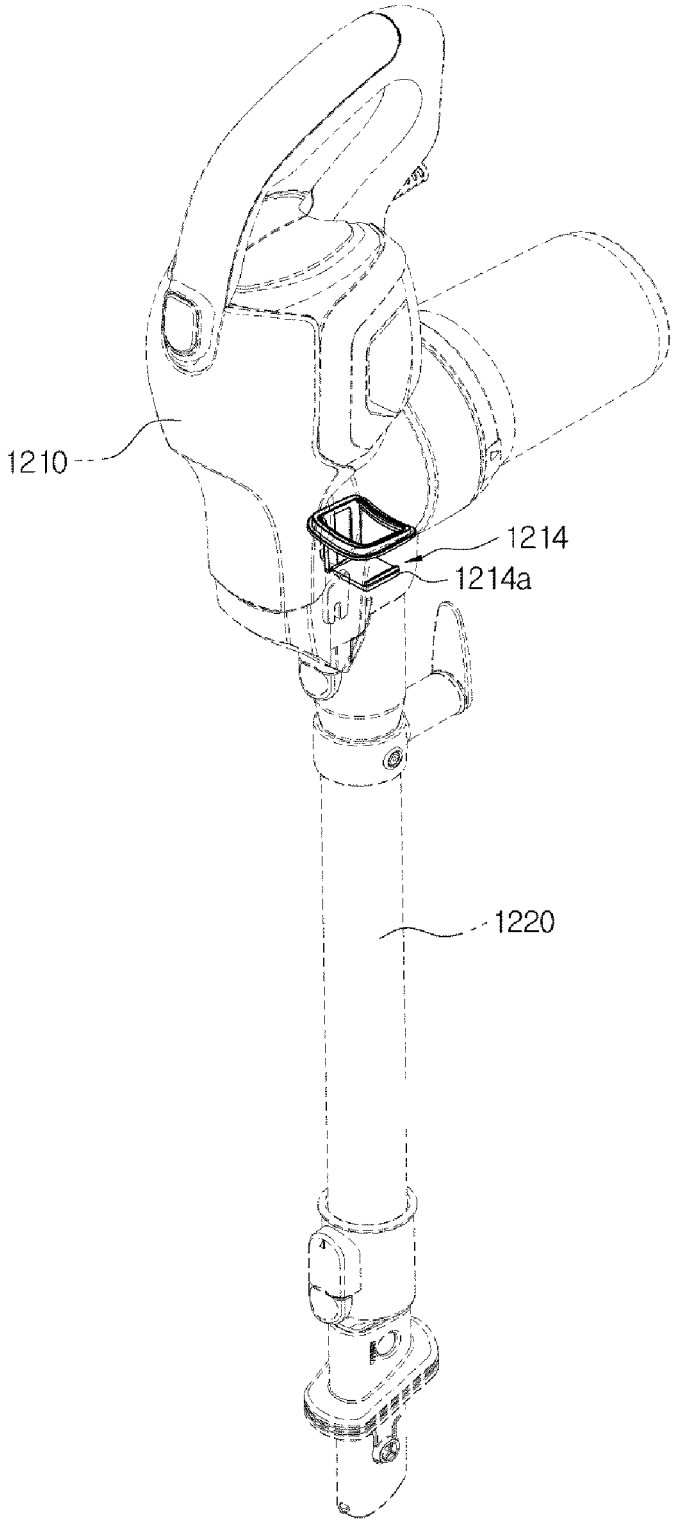
FIG. 5 is a perspective view of a damper for opening/closing an internal channel of the second cleaner module in the vacuum cleaner according to the embodiment of the present disclosure.

As illustrated in FIG. 5, a damper 1214 for preventing foreign materials from leaking through the extension pipe 1220 is disposed inside the second body 1210. The damper 1214 is disposed on a channel that connects the extension pipe 1220 and the second fan motor, and selectively opens/closes the channel according to an operation of the second fan motor. Further, the damper 1214 also serves to prevent the foreign materials from leaking through the extension pipe 1220 with the second cleaner module 1200 mounted on the extension frame 1150.

Such a damper 1214 includes a damper section 1214*a* that is formed of an elastically deformable material and opens/closes the channel. Thus, when the second fan motor is not used, the damper section 1214*a* is kept closing the channel connected to the extension pipe 1220. When the second fan motor is driven to generate the suction force, the damper section 1214*a* is elastically deformed to open the channel by the suction force generated from the second fan motor. Further, when the second fan motor is stopped to generate no suction force, the damper section 1214*a* is elastically restored again to close the channel.

Meanwhile, a rear face of the extension frame 1150 is provided with a seating recess 1150*a* on which the extension pipe 1220 is seated, and a lower portion of the extension frame 1150 is provided with a catching recess 1150*b* on which a leading end (a lower end of the extension pipe 1220 based on the drawings) of the extension pipe 1220 is caught and supported. Thus, in a state in which the second cleaner module 1200 is coupled to the extension frame 1150, the extension pipe 1220 is inserted into and supported in the seating recess 1150*a* and the catching recess 1150*b*. Thereby, the second cleaner module 1200 can be stably kept installed on the extension frame 1150 without arbitrary movement relative to the extension frame 1150. Further, in this way, the extension pipe 1220 is installed on the extension frame 1150 through the seating recess 1150*a* and the catching recess 1150*b*, so that an effect of reinforcing strength of the extension frame 1150 due to the extension pipe 1220 can be achieved.

When the vacuum cleaner does cleaning in an upright mode, the dust is collected through the first fan motor and the first dust collection unit 1130 included in the first cleaner module 1100. When cleaning is done in a handy mode, the dust is collected through the second fan motor and the second dust collection unit 1230 included in the second cleaner module 1200.

Thus, the first fan motor and the first dust collection unit 1130 are designed to be able to suction a large quantity of air and to collect a large quantity of dust at the sacrifice of weight. The second fan motor and the second dust collection unit 1230 are designed to suction a relative small quantity of air, to collect a relative small quantity of dust, and to have a light weight. When used in the upright mode, the vacuum cleaner may be designed to have a relatively high suction performance. When used in the handy mode in which the second cleaner module 1200 is separated from the first cleaner module 1100, the user can hold and use the second cleaner module 1200 with ease.

Further, as described above, since the second cleaner module 1200 is removably installed on the extension frame 1150, the user can displace the first cleaner module 1100 using the handle 1211 provided for the second cleaner module 1200. In other words, the handle 1211 provided for the second cleaner module 1200 is used when cleaning is done in the upright mode as well as when cleaning is done in the handy mode.

Figure 6:
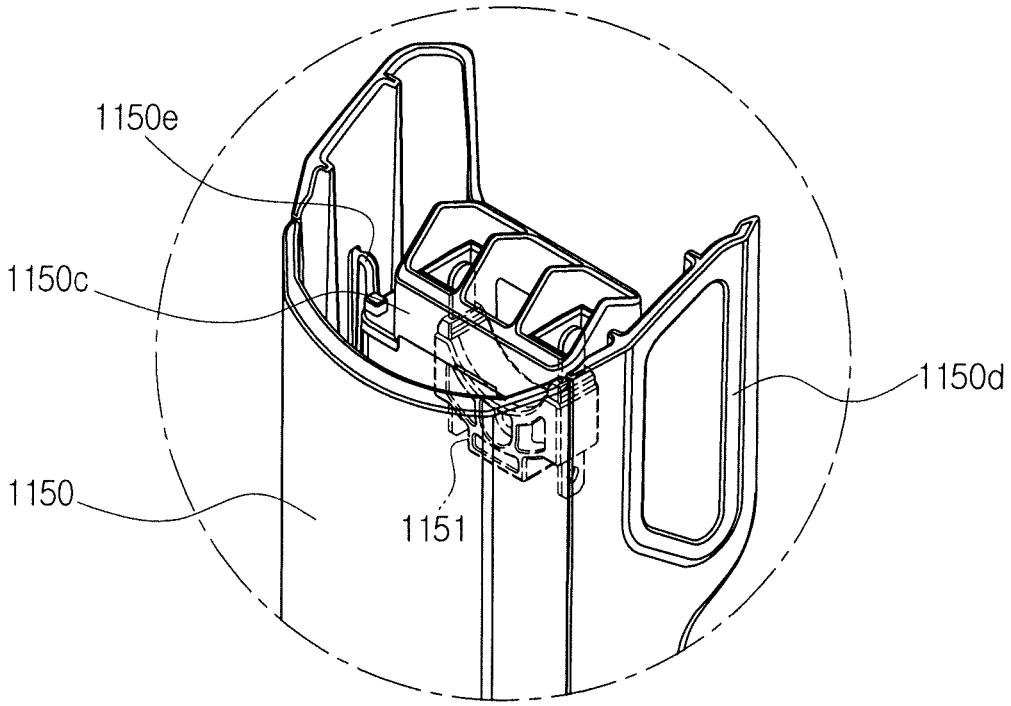
FIG. 6 is an enlarged view of a male coupler provided for an extension frame in the vacuum cleaner according to the embodiment of the present disclosure.
Figure 7:
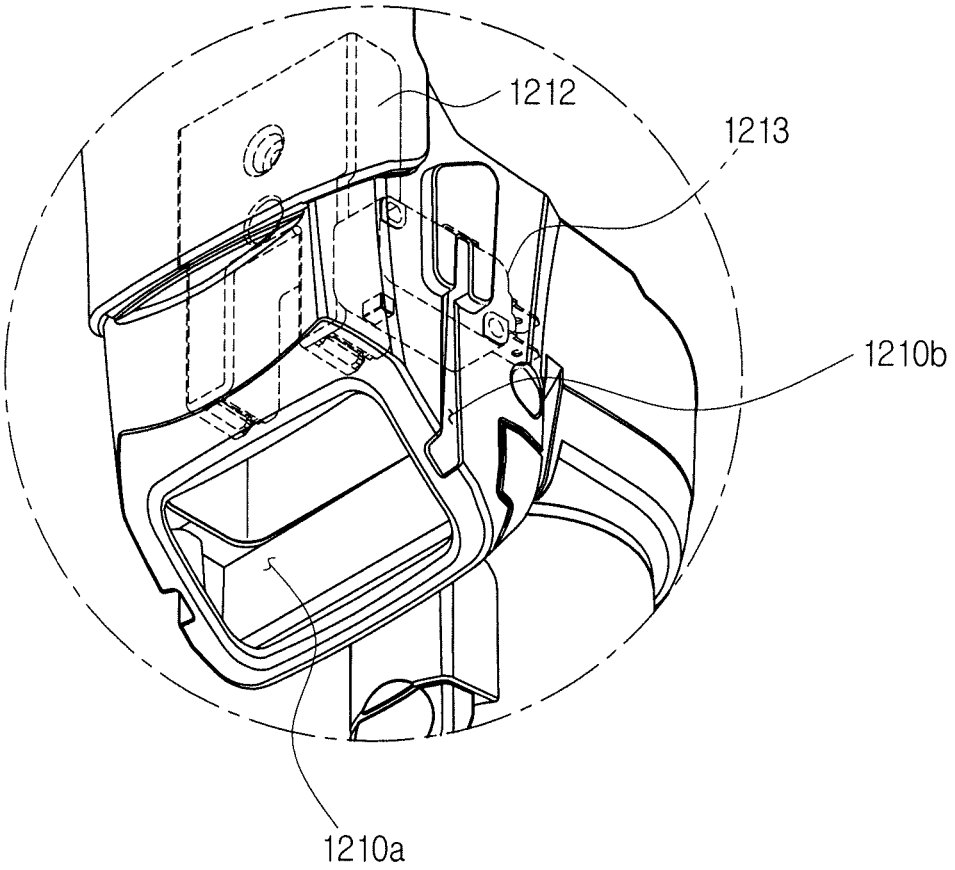
FIG. 7 is an enlarged view of a female coupler provided for a second body in the vacuum cleaner according to the embodiment of the present disclosure.

Further, as illustrated in FIGS. 6 and 7, the extension frame 1150 has a protruding male coupler 1150*c*, and the second body 1210 has a recessed female coupler 1210*a* into which the male coupler 1150*c* is fitted, such that the second cleaner module 1200 is removably coupled to the first cleaner module 1100.

Further, as described above, the second cleaner module 1200 has the extension cable 1240 and the plug 1250. Since power is supplied to the second cleaner module 1200, the first cleaner module 1100 is supplied with the power via the second cleaner module 1200.

To this end, a plug module 1151 for electrical connection is disposed at the male coupler 1150*c*, and a socket module 1212 is disposed in the female coupler 1210*a*.

Further, the female coupler 1210*a* is provided with a switch 1213 such that the power is selectively applied to the socket module 1212 only when the male coupler 1150*c* is coupled to the female coupler 1210*a*. The switch 1213 is pressed by a tip of the male coupler 1150*c*, and is adapted to allow the power to be applied to the socket module 1212.

Thus, as the male coupler 1150*c* is inserted into the female coupler 1210*a*, the plug module 1151 is connected to the socket module 1212, and the power is applied to the socket module 1212 by the switch 1213. Thus, the first cleaner module 1100 can be supplied with the power from the second cleaner module 1200.

Further, an upper end of the extension frame 1150 is provided with a cover 1150*d* that is formed away from the male coupler 1150*c* and encloses a part of the second body 1210 adjacent to the female coupler 1210*a* when the male coupler 1150*c* is coupled to the female coupler 1210*a*. Here, a guide rail 1150*e* is formed on an inner surface of the cover 1150*d* so as to guide the second body 1210 entering along the cover, and a guide groove 1210*b* is recessed in an outer surface of the second body 1210 adjacent to the female coupler 1210*a*, so that the second body 1210 can accurately enter along the cover 1150*d*. Thus, the plug module 1151 and the socket module 1212 can be accurately coupled and connected.

As described above, the plug module 1151 is coupled to the socket module 1212, the male coupler 1150*c* is fitted into the female coupler 1210*a*, and a part of the outer surface of the second body 1210 adjacent to the female coupler 1210*a* is coupled inside the cover 1150*d*. In other words, the second cleaner module 1200 is triply coupled to the extension frame 1150 of the first cleaner module 1100, and thus the second cleaner module 1200 can be stably kept installed on the extension frame 1150 of the first cleaner module 1100.

In the present embodiment, the plug module 1151 and the socket module 1212 are provided for the male coupler 1150*c* and the female coupler 1210*a* which are coupled with each other, but are not limited thereto. The plug module 1151 and the socket module 1212 may be provided to be opposite to each other at other positions. In detail, the plug module 1151 may be provided for the cover 1150*d* of the extension frame 1150, and the socket module 1212 may be provided outside the female coupler 1210*a* of the second body 1210 so as to be opposite to the plug module 1151. Further, the plug module 1151 may be provided for the extension frame 1150 so as to correspond to the leading end of the extension pipe 1220 mounted on the extension frame 1150, and the socket module 1212 may be provided for the leading end of the extension pipe 1220.

Further, in the present embodiment, the plug module 1151 is disposed at the male coupler 1150*c*, and the socket module 1212 is disposed at the female coupler 1210*a*. However, this is only an example. Conversely, the plug module may be disposed at the female coupler, and the socket module may be disposed at the male coupler.

Figure 8:
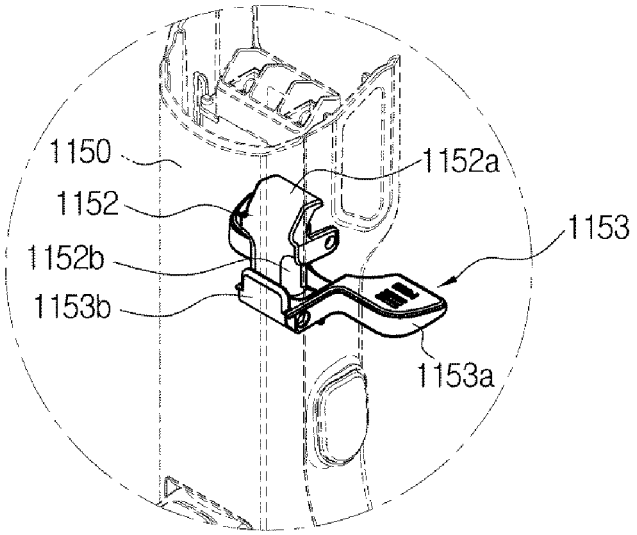
FIG. 8 is a perspective view of a locking device for locking the second cleaner module in the vacuum cleaner according to the embodiment of the present disclosure.
Figure 9:
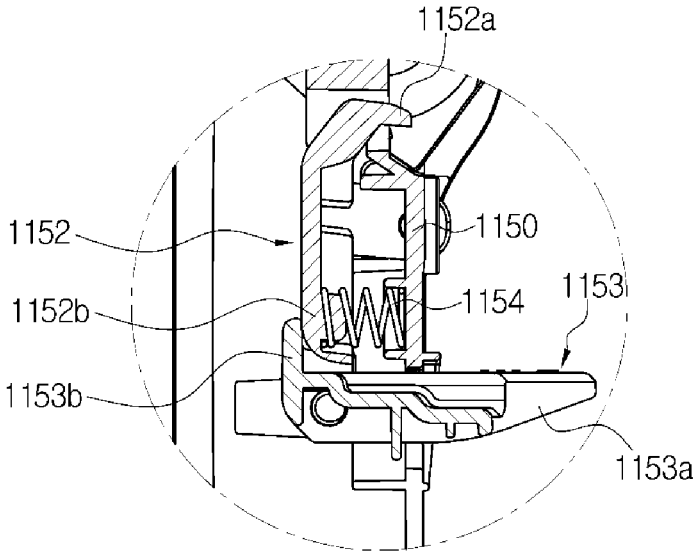
FIGS. 9 and 10 are schematic views illustrating an operation of the locking device for locking the second cleaner module in the vacuum cleaner according to the embodiment of the present disclosure.

Further, to allow the second cleaner module 1200 to be stably kept coupled to the extension frame 1150 of the first cleaner module 1100, a structure for locking the second cleaner module 1200 is installed on the extension frame 1150 as illustrated in FIGS. 8 and 9.

The locking structure includes a locking member 1152 that is rotatably installed on the extension frame 1150, an elastic member 1154 that elastically supports the locking member 1152 and causes one end of the locking member 1152 to protrude from the extension frame 1150 when the locking member 1152 is rotated in a first direction, and a lever 1153 that is rotatably installed on the extension frame 1150 and is rotated by a transmitted external force so as to rotate the locking member 1152 in a second direction opposite to the first direction.

The lever 1153 includes a lever section 1153*a* that receives a force from a user such that the lever 1153 can be rotated, and a pressing section 1153*b* that presses the locking member 1152 by the rotation of the lever 1153 such that the locking member is rotated in the second direction.

The locking member 1152 includes a locking section 1152*a* whose tip protrudes from the extension frame 1150 to be locked in a locking recess 1210*c* formed in the second cleaner module 1200, and an interlocking section 1152*b* that interacts with the pressing section 1153*b* by the rotation of the lever 1153 such that the locking member 1152 is rotated in the second direction.

Accordingly, as illustrated in FIG. 9, in the state in which the second cleaner module 1200 is installed on the first cleaner module 1100, the locking member 1152 is elastically supported in the first direction by an elastic restoration force of the elastic member 1154, and the tip of the locking section 1152*a* is kept locked in the locking recess 1210*c*. In this state, the user cannot separate the second cleaner module 1200 from the first cleaner module 1100.

Figure 10:
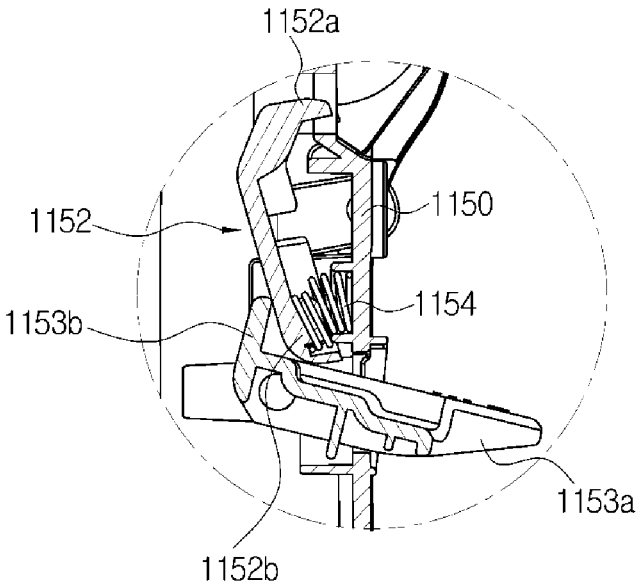

Further, as illustrated in FIG. 10, when the user applies a force to the lever section 1153*a* to rotate the lever 1153, the pressing section 1153*b* of the lever 1153 interacts with the interlocking section 1152*b* of the locking member 1152 by the rotation of the lever 1153, and rotates the locking member 1152 in the second direction. The tip of the locking section 1152*a* is separated from the locking recess 1210*c* by the rotation of the locking member 1152. In this state, the user can separate the second cleaner module 1200 from the first cleaner module 1100.

Figure 11:
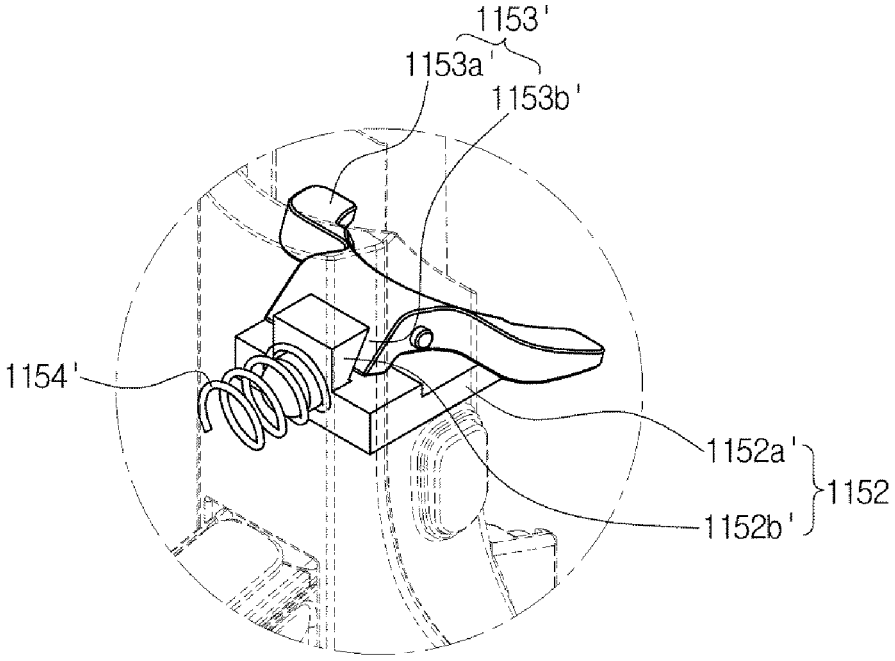
FIG. 11 is a perspective view illustrating another example of the locking device for locking the second cleaner module in the vacuum cleaner according to the embodiment of the present disclosure.
Figure 12:
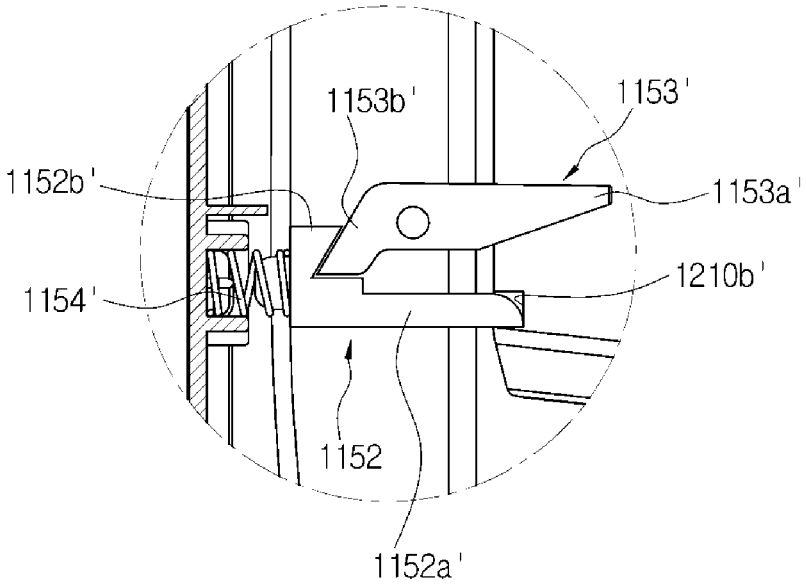
FIGS. 12 and 13 are schematic views illustrating an operation of the other example of the locking device for locking the second cleaner module in the vacuum cleaner according to the embodiment of the present disclosure.
Figure 13:
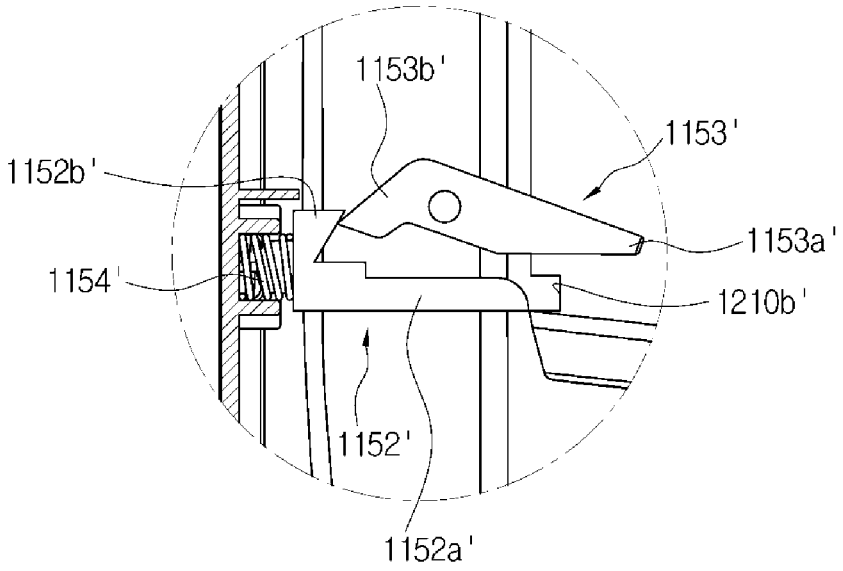

In the present embodiment, the locking member 1152 is rotatably installed, and is locked or unlocked by the rotation, which shows an example. As illustrated in FIGS. 11-13, the locking structure may include a locking member 1152' that is movably installed on the extension frame 1150, an elastic member 1154' that elastically supports the locking member 1152' such that the locking member 1152' moves in a first direction, and a lever 1153' that is rotatably installed on the extension frame 1150, and is rotated by a transmitted external force such that the locking member 1152' moves in a second direction opposite to the first direction. As a user rotates the lever 1153', the locking member 1152' may be locked or unlocked while moving.

In the present embodiment, the switch is a three-phase switch, and is adapted to selectively supply power to any one of the first and second cleaner modules 1100 and 1200 depending on whether the second cleaner module 1200 is mounted or demounted, but not limited thereto. The switch may be a two-phase switch, be adapted to selectively apply power to the second dust collection unit 1230 depending on whether or not the second cleaner module 1200 is separated. The power may be applied to the first cleaner module 1100 by a separate button (not shown) provided for the first cleaner module 1100.

In the present embodiment, the extension cable 1240 and the plug 1250 are connected to the second cleaner module 1200 such that the first cleaner module 1100 is supplied with the power via the second cleaner module 1200, but not limited thereto. The extension cable and the plug may be connected to the first cleaner module 1100, and the second cleaner module 1200 may have a rechargeable battery (not shown) housed therein.

In this case, the rechargeable battery housed in the second cleaner module 1200 is charged when the second cleaner module 1200 is coupled to the first cleaner module 1100. After the second cleaner module 1200 is separated from the first cleaner module 1100, the rechargeable battery supplies power to the second cleaner module 1200 such that the second cleaner module 1200 can be operated.

Hereinafter, a vacuum cleaner according to a second embodiment of the present disclosure will be described in detail with reference to the drawings.

Figure 14:
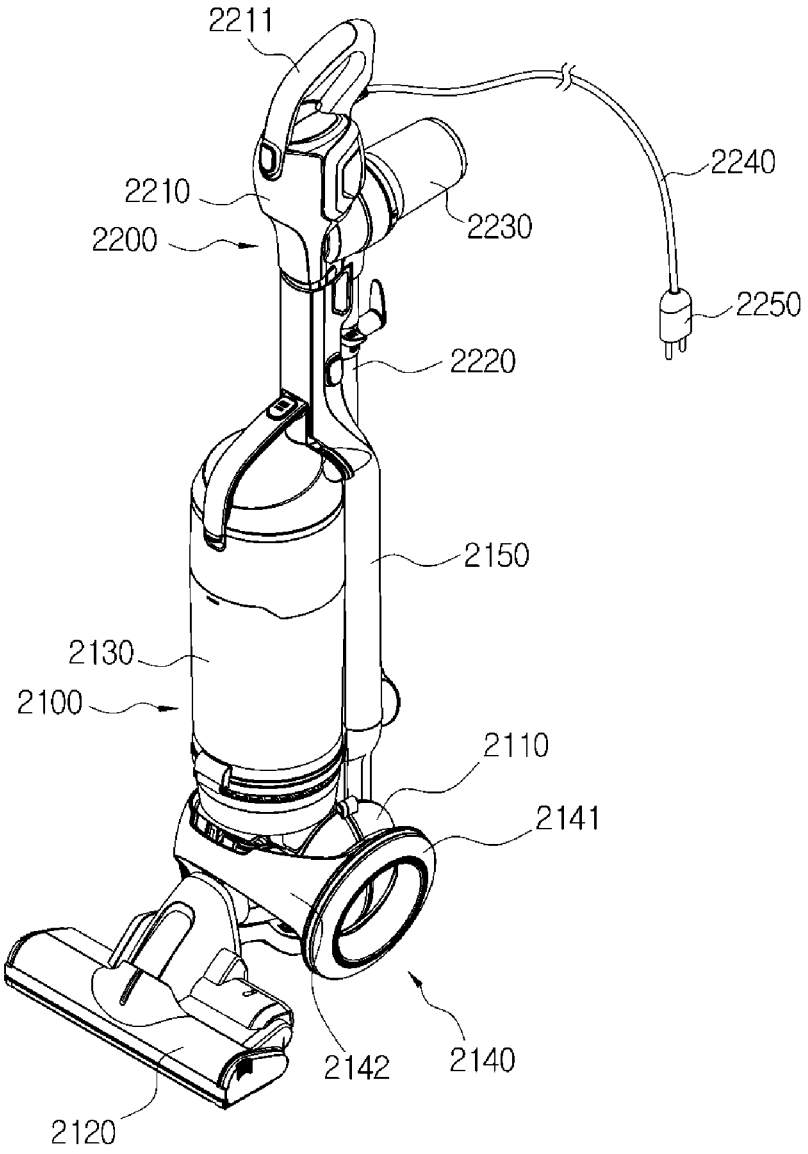
FIG. 14 is a perspective view of a vacuum cleaner according to another embodiment of the present disclosure.
Figure 15:
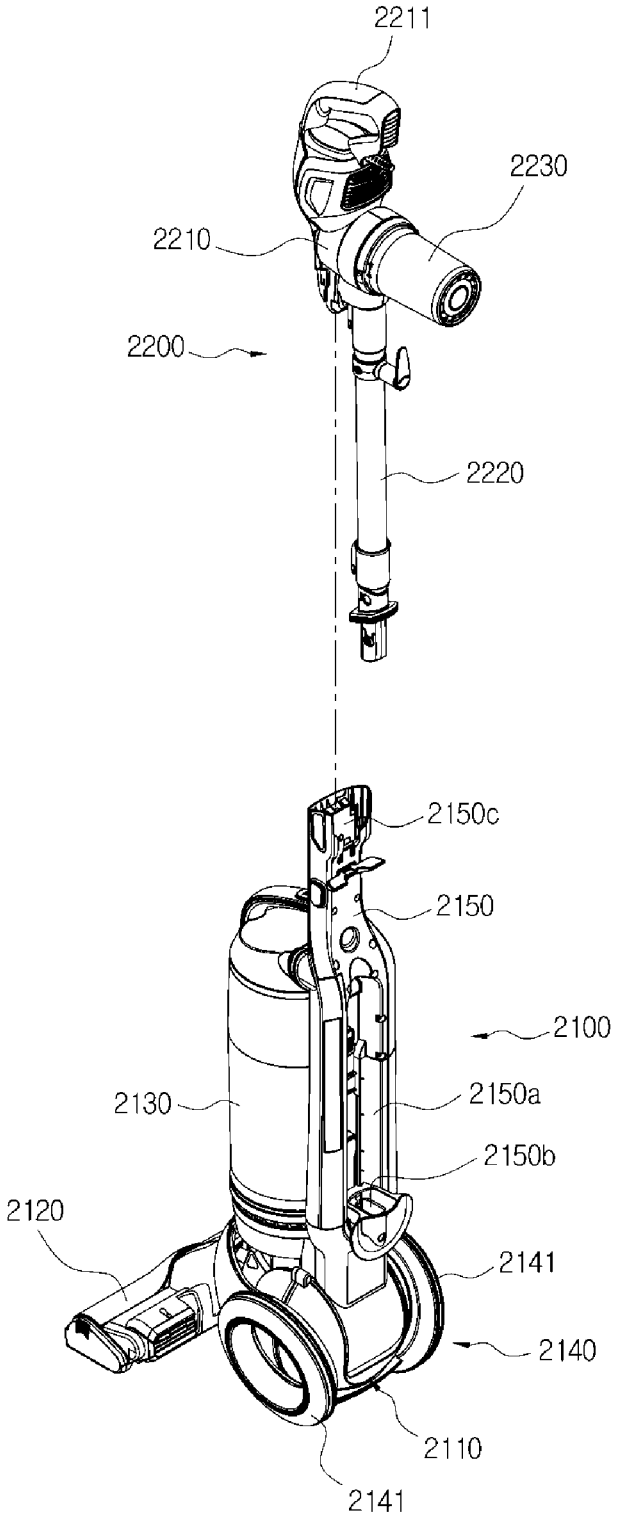
FIG. 15 is an exploded perspective view illustrating a state in which a second cleaner module is separated from a first cleaner module in the vacuum cleaner according to the other embodiment of the present disclosure.

As illustrated in FIGS. 14 and 15, a vacuum cleaner according to a second embodiment of the present disclosure includes a first cleaner module 2100 that allows a floor to be cleaned in an upright mode, and a second cleaner module 2200 that is removably installed on the first cleaner module 2100 and is separated from the first cleaner module 2100 so as to enable cleaning in a handy mode.

The first cleaner module 2100 includes a first body 2110 in which a first fan motor (not shown) generating a suction force is housed, a head unit 2120 that is connected to a front side of the first body 2110, comes into contact with a floor to be cleaned, and suctions dust on the floor along with air, a first dust collection unit 2130 that separates the dust from the air suctioned through the head unit 2120 by the suction force generated from the first fan motor, a wheel assembly 2140 that is mounted on the first body 2110 and allows the first body 2110 to move along the floor to be cleaned, and an extension frame 2150 that extends upwardly from the first body 2110. The second cleaner module 2200 is removably installed on the extension frame 2150.

The first fan motor generating the suction force is mounted in the first body 2110, and the first body 2110 can move along the floor through the wheel assembly 2140. Further, the first dust collection unit 2130 described above is mounted on an upper portion of the first body 2110.

The first dust collection unit 2130 receives the air suctioned by the head unit 2120, separates the dust included in the air, and collects the separated dust. In the present embodiment, the first dust collection unit 2130 separates and collects the dust from the air in a cyclone mode.

The wheel assembly 2140 includes a pair of wheels 2141 disposed on both left and right sides, and a wheel bracket 2142 on which the two wheels 2141 are rotatably installed and which rotatably supports the first body 2110.

The second cleaner module 2200 includes a second body 2210 in which a second fan motor (not shown) generating a suction force is housed, an extension pipe 2220 that is provided at one side of the second body 2210 so as to enable a user to do cleaning in a separated state from a target to be cleaned, a second dust collection unit 2230 that separates the dust from the air suctioned through the extension pipe 2220 and collects the separated dust, and an extension cable 2240 and a plug 2250 which are used for connection to an external power supply (not shown). The second body 2210 includes a handle 2211 at one side thereof such that the user can grasp the handle to use the second cleaner module 2200.

The second fan motor generating the suction force is mounted in the second body 2210. Based on the drawings, the aforementioned handle 2211 is provided at an upper end of the second body 2210, and the aforementioned extension pipe 2220 is connected to a lower end of the second body 2210.

The extension pipe 2220 is removably installed on the second body 2210. The extension pipe 2220 is connected to the second body 2210 such that air can be suctioned through the extension pipe 2220, or the extension pipe 2220 is separated from the second body 2210 such that air can be directly suctioned to the second body 2210.

A rear face of the extension frame 2150 is provided with a seating recess 2150*a* on which the extension pipe 2220 is seated, and a lower portion of the extension frame 2150 is provided with a catching recess 2150*b* on which a leading end (a lower end of the extension pipe 2220 based on the drawings) of the extension pipe 2220 is caught and supported. The extension frame 2150 also has a coupler 1150*c*. Thus, in a state in which the second cleaner module 2200 is coupled to the extension frame 2150, the extension pipe 2220 is inserted into and supported in the seating recess 2150*a* and the catching recess 2150*b*. Thereby, the second cleaner module 2200 can be stably kept installed on the extension frame 2150 without arbitrary movement relative to the extension frame 2150. Further, in this way, the extension pipe 2220 is installed on the extension frame 2150 through the seating recess 2150*a* and the catching recess 2150*b*, so that an effect of reinforcing strength of the extension frame 2150 due to the extension pipe 2220 can be achieved.

When the vacuum cleaner does cleaning in an upright mode, the dust is collected through the first fan motor and the first dust collection unit 2130 included in the first cleaner module 2100. When cleaning is done in a handy mode, the dust is collected through the second fan motor and the second dust collection unit 2230 included in the second cleaner module 2200.

Figure 16:
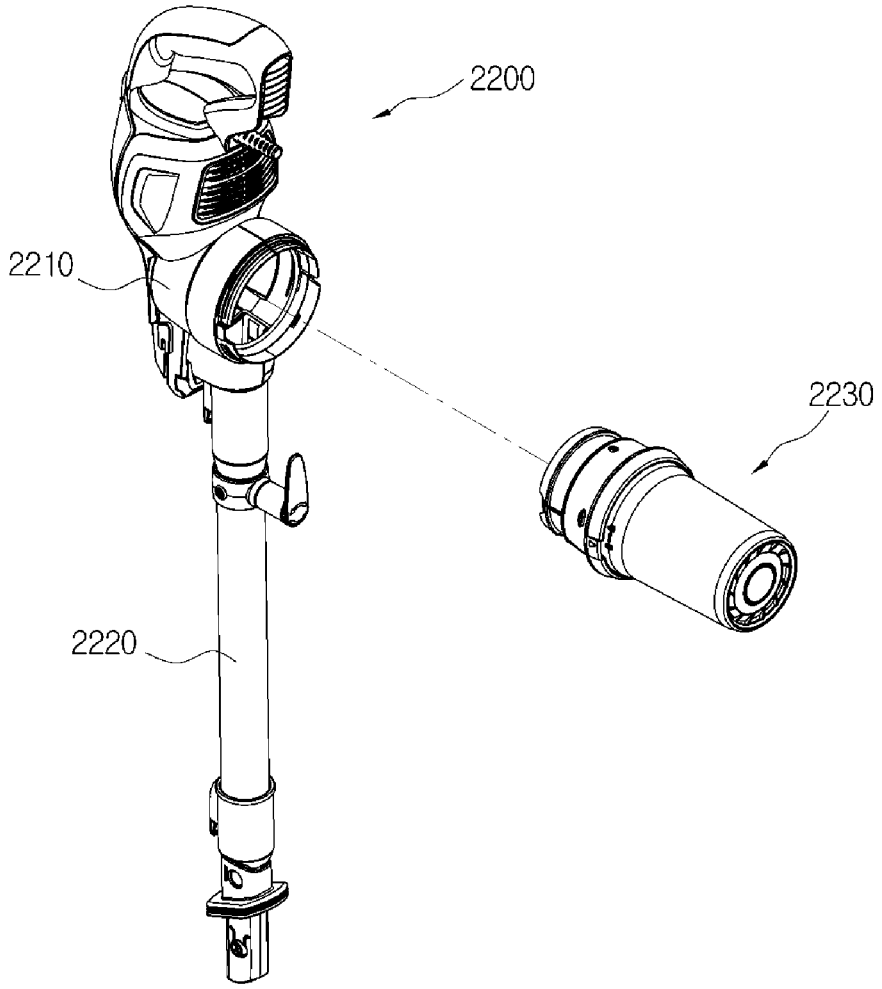
FIG. 16 is an exploded perspective view illustrating a state in which a second dust collection unit is separated from the second cleaner module in the vacuum cleaner according to the other embodiment of the present disclosure.

As illustrated in FIG. 16, the second dust collection unit 2230 is removably installed on the second body 2210, and is adapted to clean its interior after being separated. In the present embodiment, the second dust collection unit 2230 separates and collects the dust from the air in a cyclone mode.

Figure 17:
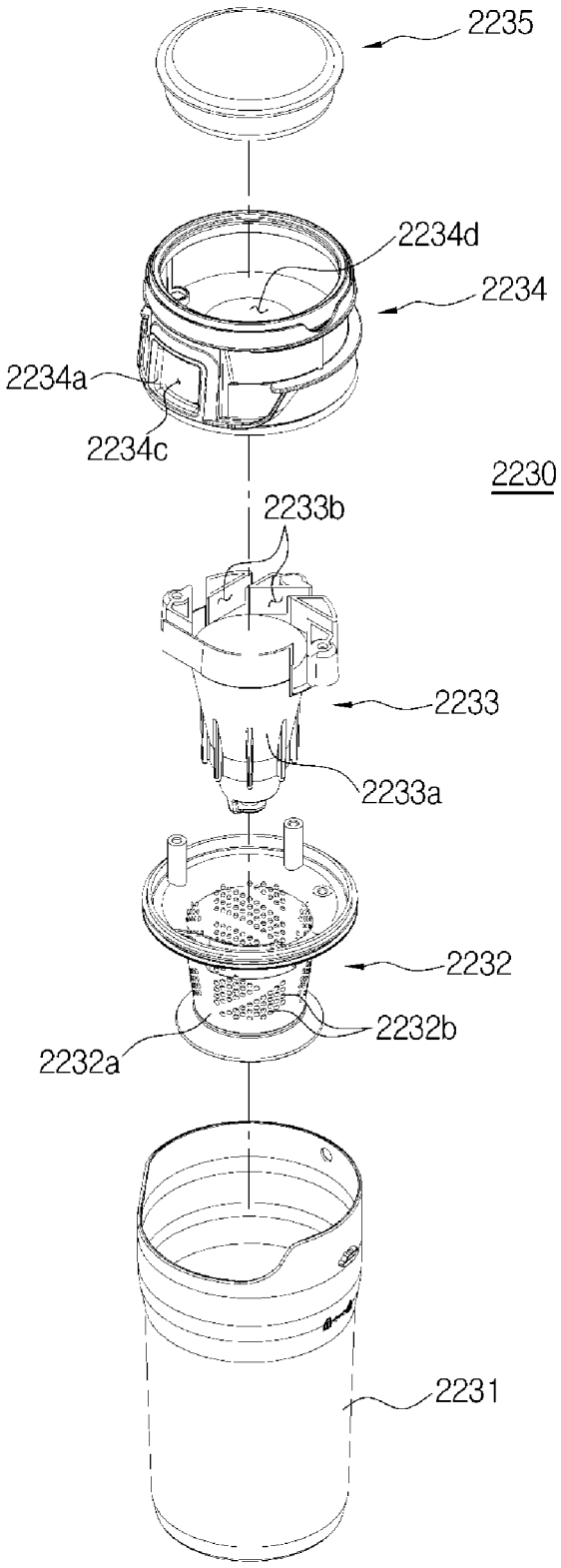
FIG. 17 is an exploded perspective view of the second dust collection unit in the vacuum cleaner according to the other embodiment of the present disclosure.
Figure 18:
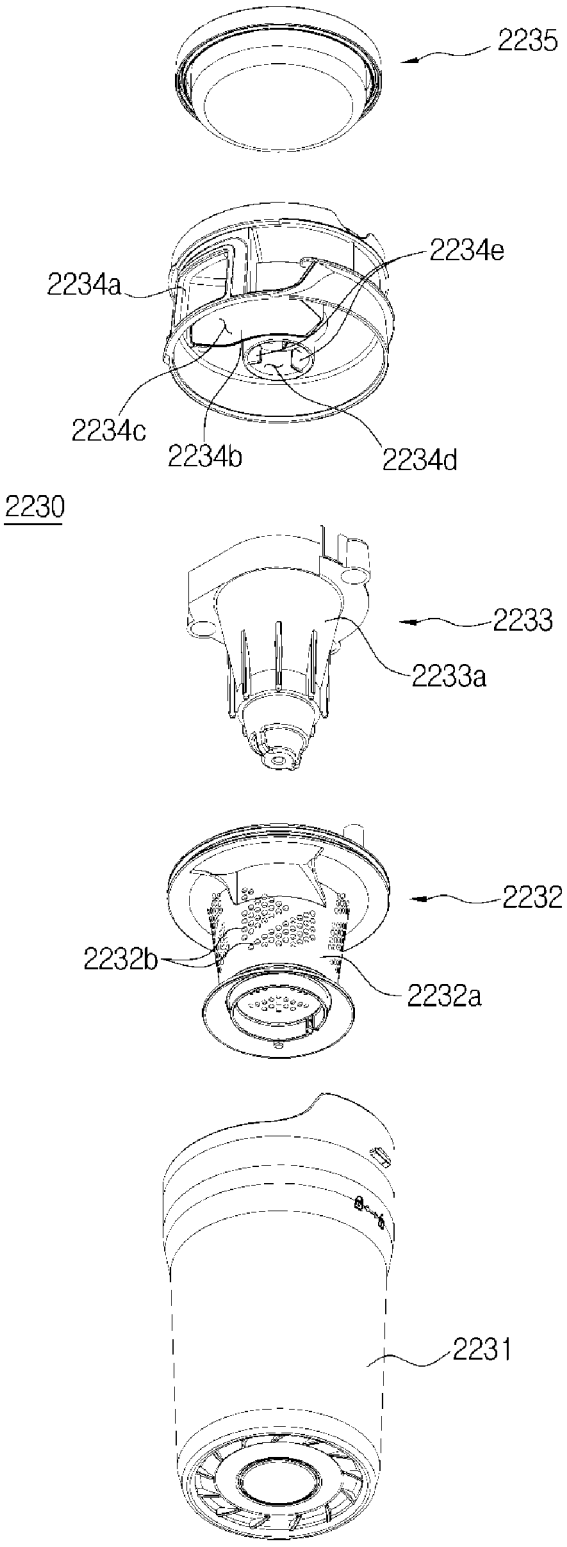
FIG. 18 is a bottom exploded perspective view of the second dust collection unit in the vacuum cleaner according to the other embodiment of the present disclosure.
Figure 19:
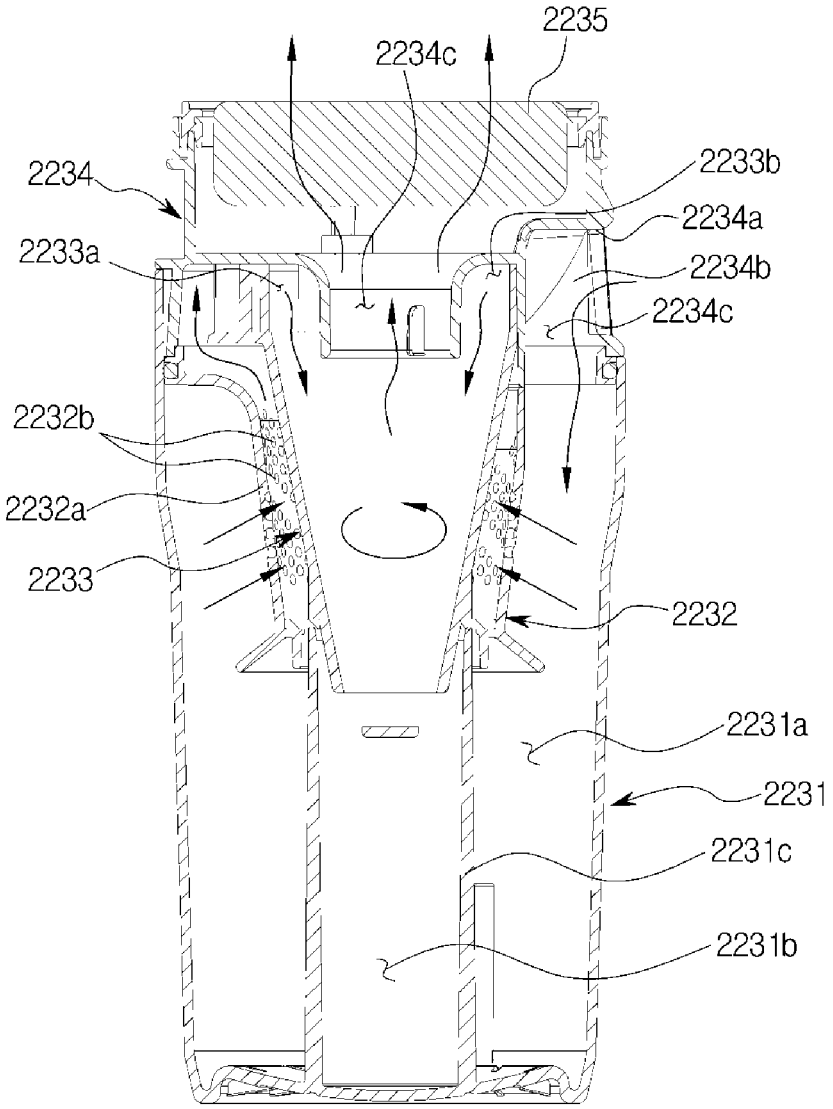
FIG. 19 is a cross-sectional view of the second dust collection unit in the vacuum cleaner according to the other embodiment of the present disclosure.

As illustrated in FIGS. 17 to 19, the second dust collection unit 2230 includes a dust collecting case 2231 which is formed in the shape of an approximately hollow cylinder, one side of which is closed, and in which the dust is collected, cyclone members 2232 and 2233 that are disposed in the dust collecting case 2231 and guide air to flow in a spiral direction so as to collect the dust, and a channel forming member 2234 that guides the air suctioned to the second dust collection unit 2230 and the air discharged from the second dust collection unit 2230.

The dust collecting case 2231 includes a first dust collecting section 2231*a* that is formed at a radial outer side of the interior of the dust collecting case 2231 in an annular shape and primarily collects the dust, and a second dust collecting section 2231*b* that is formed in the center of the interior of the dust collecting case 2231 in a cylindrical shape and secondarily collects the dust. The dust collecting case 2231 includes a partition 2231*c* that is formed in an annular shape and partitions the first and second dust collecting sections 2231*a* and 2231*b* in a radial direction.

The channel forming member 2234 includes a suction port 2234*a* which an outer circumferential surface thereof is partly open to form and into which the air is suctioned, and a suction guide 2234*b* that is provided inside the suction port 2234*a*, inclinedly extends toward the dust collecting case 2231, and guides the air toward the dust collecting case 2231. The suction guide 2234*b* forms a first suction channel 2234*c* guiding the air suctioned to the first dust collecting section 2231*a*. The first suction channel 2234*c* is formed in a direction tangent to the first dust collecting section 2231*a* such that air flows in the first dust collecting section 2231*a* in a cyclonical way. In the present embodiment, the second dust collection unit 2230 is installed on the second body 2210 such that the suction port 2234*a* is opposite to the extension pipe 2220.

The center of the channel forming member 2234 is provided with a discharge channel 2234*d* allowing the air passing through the second dust collection unit 2230 to be discharged. Multiple guide ribs 2234*e* for guiding the air passing through the discharge channel 2234*d* are disposed on an inner circumferential surface of the discharge channel 2234*d* away from one another in a circumferential direction.

Further, a filter 2235 is disposed on the channel forming member 2234. The filter 2235 is installed to cover the discharge channel 2234*d*, and filters foreign materials included in the air discharged through the discharge channel 2234*d*.

The cyclone members 2232 and 2233 are made up of a first cyclone member 2232 that causes foreign materials to be collected on the first dust collecting section 2231*a*, and a second cyclone member 2233 that is disposed inside the first cyclone member 2232 and guides foreign materials so as to be collected on the second dust collecting section 2231*b*.

The first cyclone member 2232 includes a first cyclone flow section 2232*a* that is formed in a hollow truncated cone shape and guides the air suctioned into the first dust collecting section 2231*a* so as to flow in a cyclonical way. The first cyclone flow section 2232*a* is provided with multiple communicating holes 2232*b* into which the air of the first dust collecting section 2231*a* can be introduced. A tip of the first cyclone flow section 2232*a* is supported on the aforementioned partition 2231*c* through a sealing member (not shown).

The second cyclone member 2233 includes a second cyclone flow section 2233*a* that is formed in a hollow truncated cone shape and is disposed inside the first cyclone flow section 2232*a* in a separated state, and multiple second suction channels 2233*b* that guides air so as to be suctioned into the second cyclone flow section 2233*a*.

In the present embodiment, the multiple second suction channels 2233*b* are sequentially disposed in a circumferential direction, and each extend in a direction tangent to the second cyclone flow section 2233*a* such that air can flow in the second cyclone flow section 2233*a* in a cyclonical way.

Figure 20:
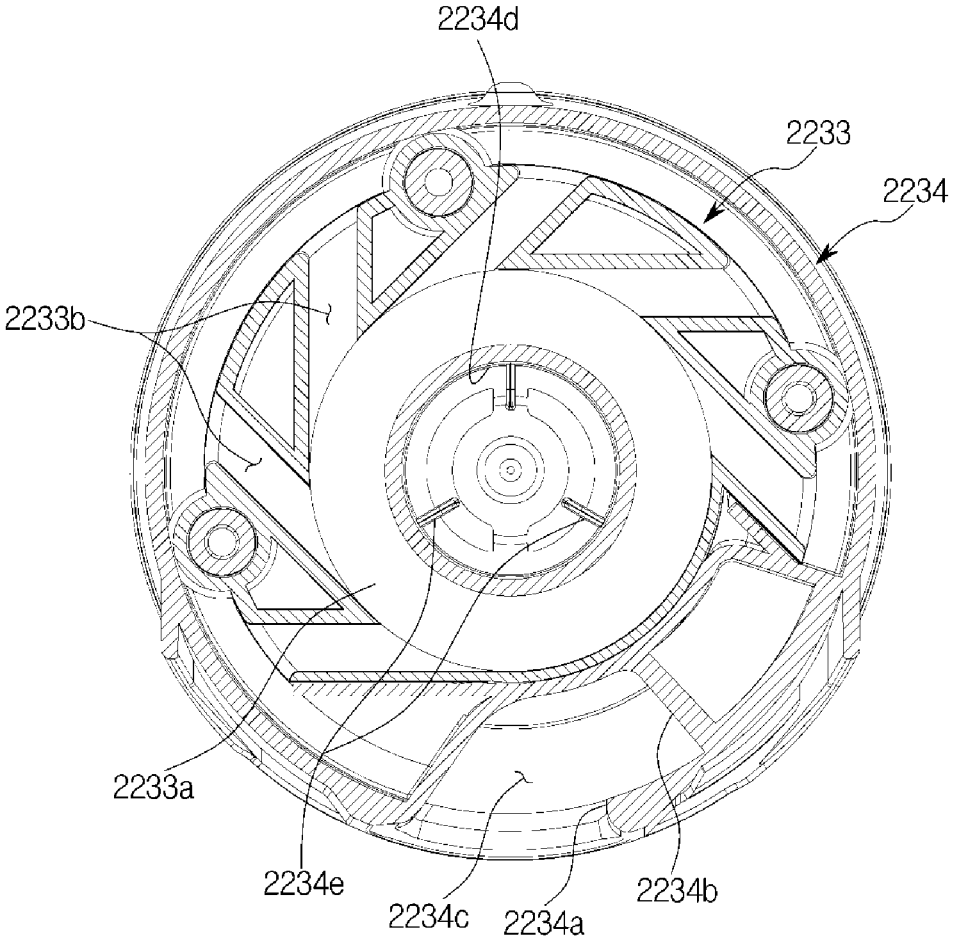
FIG. 20 is a cross-sectional view of a dust collection unit for illustrating first and second suction channels in the vacuum cleaner according to the other embodiment of the present disclosure.

In the present embodiment, the first suction channel 2234*c* and the multiple second suction channels 2233*b* are located on the same circumference as illustrated in FIG. 20. This is intended to allow the first suction channel 2234*c* and the multiple second suction channels 2233*b* to be all formed in a circular space. With this configuration, no protrusion is present to form a channel outside the second dust collection unit 2230 formed in an approximately cylindrical shape, so that a size of the second dust collection unit 2230 can be minimized.

In the present embodiment, the first suction channel 2234*c* is provided for the channel forming member 2234, and the second suction channels 2233*b* are formed in the second cyclone member 2233, but not limited thereto. The multiple second suction channels may be sequentially formed in one member in a circumferential direction along with the first suction channel.

In the present embodiment, the second dust collection unit 2230 includes, but is not limited to, one first suction channel 2234*c* and multiple second suction channels 2233*b*. The second dust collection unit may be also configured to include one first suction channel and one second suction channel, multiple first suction channels and one second suction channel, or multiple first suction channels and multiple second suction channels.

In the present embodiment, the structure of the second dust collection unit used in the handy mode has been described as an example. However, such a structure may also be applied to the first dust collection unit used to clean the floor with or without further modification.

Although a few embodiments of the present disclosure have been shown and described, it would be appreciated by those skilled in the art that changes may be made in these embodiments without departing from the principles and spirit of the invention, the scope of which is defined in the claims and their equivalents.

What is claimed is:

1. A vacuum cleaner comprising:

a first cleaner module to clean a floor in an upright mode, the first cleaner module including a first body that generates a suction force to suction air, a first dust collection unit to filter foreign materials from the air suctioned by the first body, and an extension frame disposed on a rear side of the first cleaner module and connected to the first body, the extension frame having a first coupler located at an upper portion of the extension frame and a recess located at a lower portion of the extension frame; and a second cleaner module that is removably coupled to a rear side of the extension frame of the first cleaner module and is separable from the first cleaner module to perform cleaning in a handy mode, the second cleaner module including a second body that generates a suction force to suction air when used in the handy mode, the second body having a second coupler coupled to the first coupler, an extension pipe extending from the second body and having an inlet portion received in the recess, and a second dust collection unit to filter foreign materials from the air suctioned by the second body; and a locking device, disposed on the rear side of the extension frame, to releasably, by a lever that is rotatably installed on the extension frame, lock to a part of the second cleaner module disposed on the rear side of the extension frame to thereby keep the second cleaner module coupled to the first cleaner module.

2. The vacuum cleaner according to claim 1, wherein the suction force that the first body generates is greater than the suction force generated by the second body.

3. The vacuum cleaner according to claim 1, wherein the second cleaner module includes a handle used for both cleaning in the upright mode and cleaning in the handy mode.

4. The vacuum cleaner according to claim 1, wherein the first cleaner module further includes a head unit that is disposed at a front side of the first body and suctions the air from the floor.

5. The vacuum cleaner according to claim 1, wherein the first coupler is a protruding male coupler, and the second coupler is a female coupler.

6. The vacuum cleaner according to claim 5, wherein:

the first cleaner module includes the male coupler for the extension frame; and the second cleaner module includes the female coupler.

7. The vacuum cleaner according to claim 6, wherein the extension frame includes a cover that is provided at an upper end thereof and covers a part of a second body adjacent to the female coupler.

8. The vacuum cleaner according to claim 7, wherein:

the cover includes a guide rail that is formed on an inner surface thereof and guides entry of the second body; and the second body includes a guide groove that is provided at a portion adjacent to the female coupler and guides the guide rail.

9. The vacuum cleaner according to claim 1, wherein one of the first coupler and the second coupler includes therein a plug module, and the other includes therein a socket module to which the plug module is connected when the first coupler is coupled to the second coupler.

10. The vacuum cleaner according to claim 9, wherein:

the first cleaner module and the second cleaner module are electrically connected to each other through the plug module and the socket module.

11. The vacuum cleaner according to claim 9, wherein the second cleaner module further includes a switch that causes power to be selectively applied to the socket module when the male coupler is coupled to the female coupler.

12. The vacuum cleaner according to claim 1, wherein the locking device further includes an elastic member.

13. The vacuum cleaner according to claim 1, wherein the locking device further includes:

a locking member that is rotatably installed on the extension frame; and an elastic member that elastically supports the locking member and causes the locking member to protrude from the extension frame to thereby lock to the part of the second cleaner module disposed on the rear side of the extension frame, when the locking member is rotated in a first direction, and wherein the lever enables a user to rotate the locking member in a second direction opposite to the first direction.

14. The vacuum cleaner according to claim 13, wherein:

the lever includes a lever section to receive a force from the user, and a first cam section that interacts with the locking member; and the locking member includes a locking section that locks into a locking recess of the second cleaner module, and a second cam section that interacts with the first cam section by the rotation of the lever.

15. The vacuum cleaner according to claim 1, wherein the locking device further includes:

a locking member disposed on the rear side of the extension frame and movable between a protruded position, in which the locking member is protruded from the extension frame to lock to the second cleaner module, and a retracted position, in which the locking member is disengaged from the second cleaner module, and an elastic member that elastically biases the locking member to the protruded portion, and wherein the lever is operable to move the locking member from the protruded position to the retracted position.

16. A vacuum cleaner comprising:

a first cleaner module to clean a floor in an upright mode, the first cleaner module including a first body that generates a suction force to suction air, a first dust collection unit to filter foreign materials from the air suctioned by the first body, an extension frame disposed on a rear side of the first cleaner module and connected to the first body, and a head unit that is disposed at a front side of the first body and suctions the air from the floor;

a second cleaner module that is removably coupled to a rear side of the extension frame of the first cleaner module and is separable from the first cleaner module to perform cleaning in a handy mode, the second cleaner module including a second body that generates a suction force to suction air when used in the handy mode, and a second dust collection unit to filter foreign materials from the air suctioned by the second body; and a locking device, disposed on the rear side of the extension frame, that releasably locks to a part of the second cleaner module disposed on the rear side of the extension frame to thereby keep the second cleaner module coupled to the first cleaner module, the locking device including a locking member that is rotatably installed on the extension frame, an elastic member that elastically supports the locking member and causes the locking member to protrude from the extension frame to thereby lock to the part of the second cleaner module disposed on the rear side of the extension frame, when the locking member is rotated in a first direction, and a lever that is rotatably installed on the extension frame and enables a user to rotate the locking member in a second direction opposite to the first direction.

17. The vacuum cleaner according to claim 16, wherein:

the lever includes a lever section to receive a force from the user, and a first cam section that interacts with the locking member; and the locking member includes a locking section that locks into a locking recess of the second cleaner module, and a second cam section that interacts with the first cam section by the rotation of the lever.

* * * * *